US006285032B1

(12) United States Patent
Hahne et al.

(10) Patent No.: US 6,285,032 B1
(45) **Date of Patent: *Sep. 4, 2001**

(54) DEVICE FOR REMOVING THE GASEOUS LAMINAR BOUNDARY LAYER OF A WEB

(75) Inventors: Ernst August Hahne, Allschwil (CH); Franz Knopf, Buhl (DE)

(73) Assignee: Eltexelektrostatik GmbH, Weil am Rhein (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/983,456

(22) PCT Filed: May 9, 1996

(86) PCT No.: PCT/EP96/01972

§ 371 Date: Jan. 13, 1998

§ 102(e) Date: Jan. 13, 1998

(87) PCT Pub. No.: WO97/03009

PCT Pub. Date: Jan. 30, 1997

(30) Foreign Application Priority Data

Jul. 13, 1995 (DE) ..... 195 25 453

(51) Int. Cl.[7] ..... H01T 19/04

(52) U.S. Cl. ..... 250/492.3; 250/324; 250/325

(58) Field of Search ..... 101/219, 424.1, 101/494, 487, DIG. 37, 489, 232; 430/937; 361/225; 399/173; 250/324, 325, 326, 492.3; 34/253

(56) References Cited

U.S. PATENT DOCUMENTS

| | | | | |
|---|---|---|---|---|
| 2,716,826 | * | 9/1955 | Huebner | 101/DIG. 37 |
| 3,298,030 | * | 1/1967 | Lewis et al. | 101/114 |
| 3,358,289 | * | 12/1967 | Lee | 101/DIG. 37 |
| 3,623,123 | * | 11/1971 | Jvirblis | 347/123 |
| 3,941,550 | * | 3/1976 | Marion | 425/463 |
| 4,359,826 | * | 11/1982 | Roundsley | 34/1 |
| 4,780,680 | * | 10/1988 | Reuter et al. | 324/455 |
| 4,859,266 | * | 8/1989 | Akasaki et al. | 156/273.1 |
| 5,024,819 | * | 6/1991 | Dinter et al. | 422/186.6 |
| 5,152,838 | * | 10/1992 | Kisler | 118/68 |
| 5,521,383 | * | 5/1996 | Furukawa et al. | 250/324 |
| 5,683,556 | * | 11/1997 | Nomura et al. | 204/164 |
| 5,907,468 | * | 5/1999 | Muz | 361/213 |

* cited by examiner

*Primary Examiner*—Daniel J. Colilla
(74) *Attorney, Agent, or Firm*—Antonelli, Terry, Stout & Kraus, LLP

(57) ABSTRACT

A device for removing the gaseous laminar boundary layer from at least one of the two sides of a material web moved in transport direction preferably at high speed, for example said web being made of paper, characterized by at least one corona-charging electrode provided with at least one elongate tip, and connectable to a positive (+U) or negative high-voltage source, and characterized by at least one counterelectrode associated with the latter and connectable to a negative (−U) or positive high voltage or ground, with corona-charging electrode on the side of material web having the boundary layer to be removed, and the associated counterelectrode being located on the other side.

6 Claims, 1 Drawing Sheet

DEVICE FOR REMOVING THE GASEOUS LAMINAR BOUNDARY LAYER OF A WEB

BACKGROUND OF THE INVENTION

The invention relates to a device for removing the gaseous laminar boundary layer from at least one of the two sides of a material web, paper for example, said web being moved in the transport direction, preferably at high speed.

Gaseous laminar boundary layers on material webs moved in air are known of themselves to be troublesome. Thus, for example when material webs are wound on a roll to form paper or film bales, including the laminar boundary layer in the winding produces a larger bale diameter for the actual length of material web to be wound than when the boundary layer is not included. In addition, for example during drying in a press, an attempt is made to expel the solvent in the printing ink(s) from the material web by drying. So-called boundary layer doctors are known for this purpose, with air jets mounted at right angles or transversely to the surface, said jets blowing air at high energy and speed against the material web to convert the laminar boundary layer in the microscopic range into a turbulent flow whose vortices have increasingly larger diameters than the thickness of the boundary layer, so that firstly they allow the solvent from the printing ink to pass through better and secondly they can be influenced by conventional blowing and/or suction nozzles for macroscopic elimination.

Such systems for drying are known especially for example in gravure, rotary-offset, and flexographic printing. In all of these printing methods, the ink dries as a result of the expulsion of the solvent or solvents, which are hydrocarbons or mixtures of alcohol and water. Because of the high speed at which the material web is transported, pronounced laminar boundary layers result that hinder both the transport of heat into the material web and the transport of solvent material out of it. Both physical principles are significant for drying.

Heat transport in a dryer based on hot air systems is responsible for the heating and therefore for the temperature increase of the material web. As a result of heat transport, the energy required to expel the solvent is provided. On the other hand, the material transport corresponds to its solvents driven out of the material web. Since drying is performed as a rule with material web temperatures above 100° C., there is still a small amount of water present that evaporates from the paper.

It is clear that the quality of a drying system depends upon the highest possible transfer of heat and material with a simultaneous small temperature differential between the ambient air and the material web. A small temperature differential necessarily means that there is a lower energy requirement provided the rest of the dryer system remains the same.

It is known from flow technology that in particular laminar boundary layers with relatively low Reynolds numbers, in conjunction with the high kinematic viscosity of hot air, exhibit low thermal and material transfer.

Since heat and material transfer in turbulent flow is a multiple of the value for laminar flow, an attempt is made in known drying systems to convert the laminar boundary layer both pneumatically and mechanically to change it to a turbulent boundary layer using the above-mentioned boundary layer doctor. As a rule, specially designed blowing nozzles are used, directed against at least one side of the material web. The results are not satisfactory despite the application of high energy. The reason is not known exactly despite intensive research. Possibly the reason for the unsatisfactory results lies in the fact that with surface roughnesses of the material web of approximately 2 to 4 $\mu$m in the case of paper, despite the conversion from a laminar to a turbulent boundary layer, a thin laminar so-called residual boundary layer is embedded so to speak in the unevennesses in the surfaces of the material web produced by the roughness, so that heat and material transport are both hindered.

This so-called boundary layer doctor can be used not only in dryers in printing presses, but theoretically in all other applications as well. Nevertheless, the efficiency remains poor.

SUMMARY OF THE INVENTION

The goal of the invention is to design a device according to the species in such fashion that boundary layers can be removed more simply and with much better efficiency.

This goal is achieved in a device for removing the gaseous laminar boundary layer from at least one of the two sides of a material web moved in transport direction preferably at high speed, for example said web being made of paper, characterized by at least one corona-charging electrode provided with at least one elongate tip, and connectable to a positive (+U) or negative high-voltage source, and characterized by at least one counterelectrode associated with the latter and connectable to a negative (−U) or positive high voltage or ground, with corona-charging electrode on the side of material web having the boundary layer to be removed, and the associated counterelectrode being located on the other side.

In the solution according to the invention, therefore, a corona-charging electrode is used in which, in the electrical field from the counterelectrode to the corona-charging electrode, a plasma channel is formed from the material web to the corona-charging electrode in the sense of a hard corona charge with direct current flowing through the latter, through which channel the charge, namely electrons, are conducted from the surface of the material web to the corona electrode, which has at least one and preferably however a plurality of points directed against one side in the direction of the surface of the material web. This produces collision ionization of the electrons in the plasma channel with gas molecules in the surrounding atmosphere, so that this molecule is ionized. According to one unconfirmed model concept, both as a result of the collision momentum of the electron on the gas molecule in the direction away from the surface of the material web on the one hand and the electrostatic force acting on the ionized gas molecule in the electrostatic field on the other hand, material transport takes place in the direction of the corona-charging electrode. The direction of movement, as already mentioned, runs transversely with respect to the flow direction of the boundary layer of the material web. As a result of this so-called ionic wind, the change from laminar to turbulent flow of the boundary layer is effected even below the critical Reynolds number. It is known that above a Reynolds number of $3\times10^6$, a partially turbulent boundary layer is created spontaneously. However, this turbulent flow of the boundary layer has a greater thickness than that of the laminar flow and therefore interacts more readily with macroscopic influences, for example other pronounced or applied air flows, for example those from the boundary layer doctor.

In addition, in the turbulent flow, vorticized areas are created with directions of movement and speeds that oppose those of the transport direction of the material web and are approximately of the same magnitude as far as their contributions are concerned, so that in this quasi-backward moving vortex, there is no relative velocity, or only a slight one, with respect to the material web, which considerably facilitates the escape of solvents and/or water.

Surprisingly, however, it has also been found that the so-called ionic wind described above, even with reversed polarity, is capable of changing the laminar flow of the boundary layer into a turbulent flow. In conjunction with the tips of the electrodes of the corona-charging electrode spaced 5 mm apart, it was observed that with negative charging of the surface of one side of the material web, in other words with electron transport from the corona-charging electrode to the surface of one side of the material web, the change took place with a much higher charge transport that corresponds to the current flowing through the corona-charging electrode than at a corona-charging electrode connected to a positive high voltage. No model concept for this behavior exists. It is believed however that possibly because, applied in the form of an electrostatic field, the energy of the colder residual boundary layer mentioned at the outset, which boundary layer can be thought of as being embedded like a fluid in the roughness of the surface of one side of the material web, is moved into the adjoining laminar flow of the boundary layer or, because of a partially elastic reflected momentum at the surface of one side of the material web. In any event, it is all the more surprising that the effect that is desired as a result of using the device according to the invention, namely changing the flow of the gaseous laminar boundary layer into a turbulent flow, can be achieved equally well with reversed polarity.

Therefore, according to the teaching of the invention, in a very simple fashion, a corona-charging electrode (or a plurality thereof) is/are provided with at least one elongate tip and is/are connectable to a positive or negative high-voltage source, while on the other side of the material web a counterelectrode is provided that is associated with the corona-charging electrode and is connectable to the high-voltage source of the other polarity or to ground. The change to turbulent flow takes place on the side on which the corona-charging electrode is located. The value of the high voltage and the spacing of the elongate tips of the individual electrodes of the corona-charging electrode must be adjusted as a function of the respective purpose, in other words the speed and temperature of the material web.

In an experiment in a dryer of a press, at the outlet of the latter, with an effective active corona electrode that has a current of approximately 0.5 mA per unit length flowing through it, said unit length being one meter, a continuous visible development of vapor from the solvent could be seen at the surface of one side of the material web. This proves that the vapor pressure differential during the passage of the material web though the dryer, despite a sufficiently high temperature of the material web, was not able to expel the solvent completely, in other words the material web could not be dried completely. The remaining solvent was expelled only by the breakup of the boundary layer according to the invention by means of the corona charge with a plasma channel, in other words using direct current and DC voltage. It should be noted that the corona-charging electrode with an electrical power of about 15 watts per unit width of the material web equal to 1 meter requires a power many times less than a correspondingly designed blowing nozzle of up to 50 kW per meter, quite apart from the heating power not taken into account.

The surprisingly high efficiency of the device according to the invention may well be due to the fact that the electrons that come free from each point on the surface of one side of the material web under the influence of the high electrical field strength between two electrodes produce a material transport that is applied directly to the surface of one side of the material web and this takes place even with very rough surfaces. Evidently, in contrast to the action of the known boundary layer doctor, which breaks up only the laminar boundary layer, with the invention the residual boundary layer is also broken up by an effect which is referred to below as total turbulence and thus results in the best possible heat transfer with maximum material transfer in conjunction with the drying of rapidly moving material webs. In addition, as a result of the improved heat transfer, the efficiency of the hot air produced to heat the material web is increased. The structural length of the dryer can also be shortened. Because of the improved material transfer, generally lower temperatures of the material web are possible, which is also of great significance for the water content in paper. In addition, the amount of surrounding air can be reduced since the part that is needed for the function of the boundary layer doctor required in the prior art is eliminated. Finally, the structural length required to expel the solvent can be shortened and significant savings can be achieved, especially in energy.

In one advantageous embodiment of the invention, the line connecting the corona-charging electrode to the counterelectrode forms an obtuse angle with the transport direction. As a result, the angle of the resultant momentum on the gas molecules increases relative to the transport direction, so that the change from laminar to turbulent flow of the boundary layer takes place more rapidly and simultaneously in greater thickness, so that an improved macroscopic attack on bubble and/or suction flows is possible.

It is especially advantageous in several embodiments, in the transport direction downstream from the first pair of corona-charging electrodes and counterelectrodes, to provide at least one additional pair consisting of a counterelectrode and a corona-charging electrode, one on each side of the material web. Thus, in the transport direction, on one side, corona-charging electrodes and counterelectrodes can be provided in series and on the other side of the material web they alternate opposite one another in the transport direction so that the boundary layer is broken up at alternating points on the upper and lower surfaces of the material web. If instead, instead of the passive counterelectrode, an active counterelectrode with elongate tips but with opposite polarity from the corona-charging electrode is connected, the boundary layer can be broken up at a given point both on the top and bottom of the material web.

A laminar flow is no longer present downstream of each disturbance, for example guide and/or reversing rolls for the material web over its entire width. It is only with increasing distance in the transport direction of the material web that it first rebuilds itself again to its essentially constant thickness. In order to shorten this build-up distance, it may be advantageous in many applications to initially help the laminar flow of the boundary layer to build up in order then to be able to use the device according to the invention earlier and with greater efficiency. For this purpose, it may be advantageous, downstream from the source of disturbance of the material web and over its entire width, to apply a laminar flow of gas or a gas mixture in the transport direction of the material web.

In addition to breaking up laminar boundary flow into turbulent boundary flow, it can be advantageous at a distance in the transport direction of the material web, downstream from the pair consisting of a corona-charging electrode and a counterelectrode, to provide blowing and/or suction nozzles known of themselves in order to remove the turbulent flow that carries the solvent and/or expelled water with it. It can also be advantageous to provide for this purpose, in the transport direction downstream from the blowing and/or suction nozzle(s), an inlet opening for the material web into a vacuum chamber in which either no laminar boundary flow or only a limited thickness thereof can form, so that the vapor pressure of the solvent or the water in the surface of one side of the material web or its residual boundary layer is sufficiently large with respect to a vacuum to allow unimpeded material transport into the vacuum.

With a very special advantage, the use of a device according to the invention in printing presses, preferably rotary-offset, gravure, and flexographic presses, is advantageous, especially in the dryers with heaters used in these presses. Even when the material web runs over cooling rolls, the boundary layer trapped between them and the material web can be an impediment to cooling so that here again the device according to the invention can be used advantageously. In addition, it is evident at many guide and/or reversing rolls of high-speed material webs, that these webs "float" transversely to their transport direction. This effect likewise can be attributed to the laminar boundary layer located in between which, when eliminated, results in very accurate and precise guidance and reversal.

BRIEF DESCRIPTION OF THE DRAWINGS

One advantageous embodiment of the invention will now be described with reference to the drawing in greater detail, with FIG. 1 being a schematic cross section through a device according to the invention with a material web being moved and located in between, in a partially cut-away view.

DETAILED DESCRIPTION OF THE PREFERRED EMBODIMENTS

Figure 1:
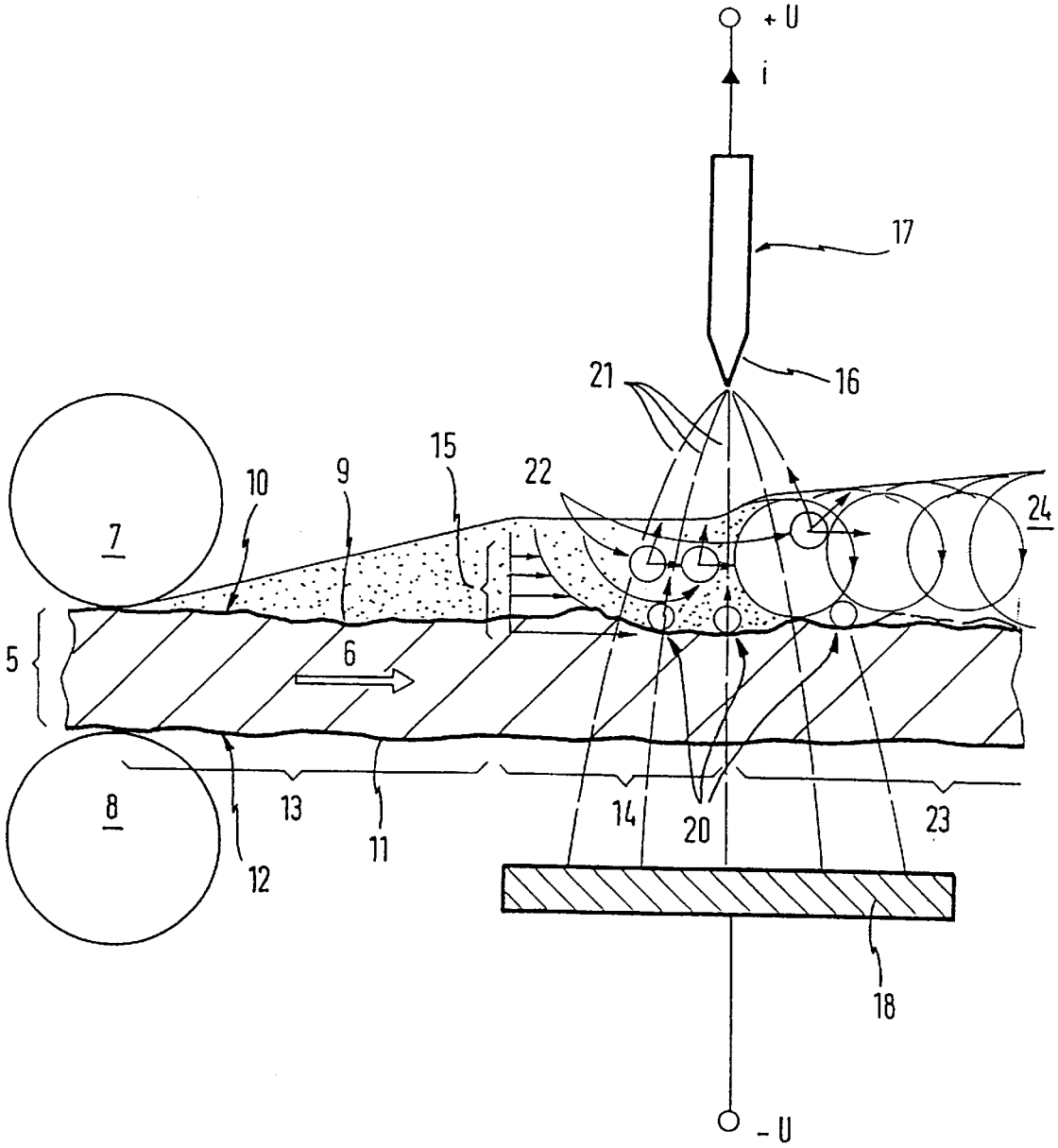

In FIG. 1, reference numeral 5 refers to the material web which is moved in transport direction 6 as indicated by the arrow and guide rolls shown schematically and marked 7 and 8, said rolls extending at right angles to transport direction 6 and located on the surface 9 of one side 10 and the surface 11 of the other side 12 of material web 5. The schematic structure of the laminar boundary layer is shown on one side 9 of material web 5. Downstream from guide roll 7 that acts as a source of disturbance, in section 13 a gaseous boundary layer develops with increasing thickness, said layer having a certain thickness 15 in area 14. On the same side, a corona-charging electrode 17 is provided, that has at least one and preferably a plurality of tips 16 parallel to one another, said electrode being connected to a positive high-voltage source +U as a DC source. On the other side 12 of web 5, a flat counterelectrode 18 is associated with it that likewise extends transversely preferably at right angles to transport direction 6, but parallel to surface 10, 12 of the material web over its entire width, which is connected to the negative high-voltage source −U.

Thus the corona-charging electrode is formed and located and connected to a voltage such that it has a constant corona-charging current i as the hard corona charge which flows through it. Because of this, from surface 9 of one side 10, electrons 20 are transported along field line 21 to the tip 16 of corona-charging electrode 17.

As they migrate in the direction of corona-charging electrode 17, electrons 20 encounter gas molecules 22 which, because of their collision with the electrons, firstly acquire momentum in the direction of the corona-charging electrode 17 and on the other hand are themselves ionized. Because of their ionization, the ionized gas molecules 22 migrate along the electrostatic field lines 21 in the direction of tip 16 of corona-charging electrode 17. The two effects are superimposed and in area 14 of the laminar boundary layer flow, cause a change to a turbulent flow in area 23. Here vortices form, represented schematically at 24, that in their areas near the surface 9 of one side 10 exhibit a velocity component that is opposite transport direction 6 of material web 5, in other words, a lower relative velocity in the area of surface 9 than in area 14 of the laminar flow of the boundary layer, so that from there, evidently a material transport from the unevennesses in surface 9 of one side 10 of material web 5 can take place and, because of the component of vortices 24 that is directed away from the material web, permits good material transport in the direction away from surface 9.

What is claimed is:

1. Device for removing a gaseous laminar boundary layer from at least one of two sides of a material web moved in air in a transport direction comprising: at least one corona-charging electrode having a plurality of elongate tips connected to a positive (+U) or negative high-voltage source, the at least one corona-charging electrode being provided on a side of the material web having the boundary layer to be removed, with the tips directly facing and spaced from the side of the material web having the boundary layer to be removed, and at least one counterelectrode connected to a negative (−U) or positive high voltage or ground provided on another side of the material web.

2. Device according to claim 1, characterized in that counterelectrode is flat and extends substantially parallel to the surface of the material web.

3. Device according to claim 2, characterized in that a line normal to an upper surface of the flat counterelectrode is made al right angles to the transport direction.

4. Device according to claim 1, wherein the material web is a paper web.

5. A method for removing a gaseous laminar boundary layer from at least one of two sides of a material web, comprising:

transporting a material web in air in a transport direction between a corona-charging electrode provided on the at least one side of the material web, the corona-charging electrode having a plurality of tips directly facing and spaced from the at least one side of the material web, and a counterelectrode provided on another side of the web; and applying a corona-charging current by electrically connecting a positive or negative high voltage source to the corona-charging electrode and electrically connecting a negative or positive high voltage source or ground to the counterelectrode so that electrons migrate by the corona-charging current through a plasma channel along electrostatic field lines between the at least one side of the material web and the plurality of tips of the corona-charging electrode and, during migration, collide with gas molecules in the gaseous boundary layer, thereby transferring momentum to and ionizing the gas molecules to direct gas molecules away from the at least one side of the material web.

6. Method according to claim 5, wherein the material web is a paper web.

* * * * *